United States Patent [19]

Edwards et al.

[11] Patent Number: 4,599,121

[45] Date of Patent: Jul. 8, 1986

[54] METHOD OF PRODUCING LEAKY COAXIAL CABLE

[75] Inventors: Hugh A. Edwards, Renfrew; John W. Patchell, Carleton Place, both of Canada

[73] Assignees: Allied Corporation, Kanata, Canada; Senstar Security Systems Corporation, Morris Township, N.J.

[21] Appl. No.: 533,853

[22] Filed: Sep. 19, 1983

[30] Foreign Application Priority Data

Apr. 15, 1983 [CA] Canada ..... 426,019

[51] Int. Cl.[4] ..... H01B 13/26

[52] U.S. Cl. ..... 156/48; 156/52; 156/55; 156/56; 174/102 SP; 333/237; 340/552; 343/5 PD

[58] Field of Search ..... 87/1, 6, 9; 156/47, 156/48, 52, 55, 56; 174/102 SP; 140/92.6; 333/237; 340/552; 343/5 PD

[56] References Cited

U.S. PATENT DOCUMENTS 3,607,487 9/1971 Biskeborn et al. ..... 156/47

4,091,367 5/1978 Harman ..... 340/552

4,339,733 7/1982 Smith ..... 333/237

4,432,193 2/1984 Maki ..... 333/237 X

*Primary Examiner*—Robert A. Dawson

*Attorney, Agent, or Firm*—Edward E. Pascal; Roger H. Criss

[57] ABSTRACT

A method of producing a leakage graded coaxial cable having a braided shield, in which ends of the shield wire are dropped as braiding progresses. Gaps in the shield having progressively increasing size are produced through which the radio frequency field leakage occurs, which facilitates providing a constant radio frequency field around the cable. The cable is coated with a jell flooding agent prior to extrusion of its protection jacket, which fills the interstices and gaps of the shield, and solidifies to a waxy, semi-resilient consistency. The resulting cable can be coiled and flexed, maintaining its shield reliability, and rejects water and fluids in case pinholes in the jacket occur.

14 Claims, 9 Drawing Figures

METHOD OF PRODUCING LEAKY COAXIAL CABLE

This invention relates coaxial cable manufacturing and particularly to a method of manufacturing leakage graded coaxial cable.

Coaxial cables which leak radio frequency energy are used for example, in some types of intrusion detector systems. In some such systems, for example a pair of cables are spaced parallel to each other along a perimeter to be protected, and a radio frequency signal is applied to one cable. The radio frequency field which leaks from that cable to the other is detected from the second cable. An intruder in the field between the cables causes a phase change in the signal received by the second cable, and signal processing of the received signal can provide evidence of intrusion of a body into the field, and in some systems, of the location of the intrusion. For the system to detect the intrusion with reliability and predictability, the amount of signal leaking from the first cable and which can penetrate the shield of the second cable must be carefully controlled.

A graded cable is necessary to obtain a controlled and constant electromagnetic field around it. Since any normal cable has resistance, a constant loss cable would cause the leaked radio frequency field surrounding the cable to decrease with distance from the source end of the cable. A graded cable having leakage which increases with distance from the source end to compensate for the resistance of the cable can maintain the leaked radio frequency field constant along its entire length.

Figure 7:
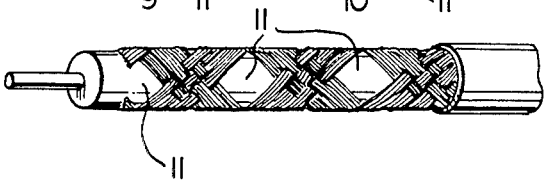

A system which utilizes such leaky coaxial cables is described in U.S. Pat. No. 4,091,367, issued May 23rd, 1978, invented by Robert K. Harman. Several types of leaky coaxial cables are shown in FIG. 7 of that patent.

In FIGS. 7A, 7B, 7D and 7E of the Harman patent a shield which is made of solid material is used in the cable. Slots are formed in the shield to allow radio frequency energy carried by the cable to escape in a controlled manner. The slots can take various forms, and can run the length of the cable. In FIG. 7 a braided shield coaxial cable is shown, having a loosely wound shield, and which includes slots spaced at one foot intervals. Both the looseness and slots apparently contribute to leakage of energy from the cable.

The solid shield coaxial cables have been found to be impractical for many applications. For example during the manufacturing process, cables are usually coiled, and due to the coiling the shield sometimes breaks or deforms, and the slots become pinched or dilated. The braided shield type of cable coils and bends properly due to the ductility of the individual wires in each strand, but the mass production of a braided shield graded cable having progressively increasing or variable leakage was not feasible.

The present invention is a method of making a graded coaxial cable from which progressively increasing and controlled radio frequency radiation leakage can be obtained. A cable is produced which utilizes a braided shield, which allows it to be coiled and reasonably bent without distortion. During manufacture the shield is filled with a heated flooding agent which solidifies to a waxy surface under its protective jacket, which substantially protects it from ambient liquids and gases should the protective jacket suffer pinholes or the like.

In general, the invention is a method of making a coaxial cable comprising preparing a conductive axial wire covered by an insulating dielectric, progressively weaving a conductive braid around the dielectric, and dropping ends of the braid according to a predefined schedule as the weaving progresses, to produce progressively larger gaps in the braid along the cable whereby graded radio frequency leakage of signal carried thereby is facilitated.

Figure 1:
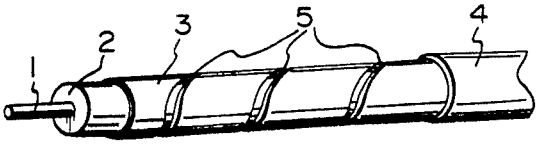
FIG. 1 PRIOR ART
Figure 2:
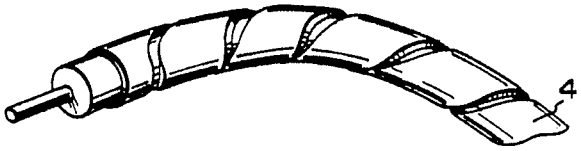
Figure 3:
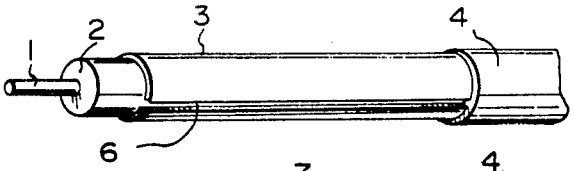
FIG. 3 PRIOR ART
Figure 4:
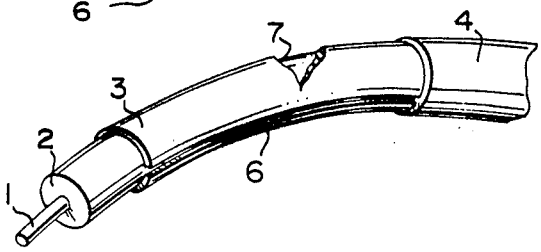
Figure 5:
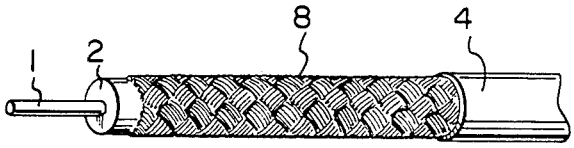
Figure 6:
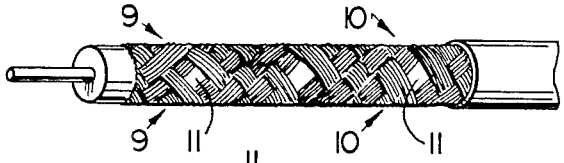
Figure 8:
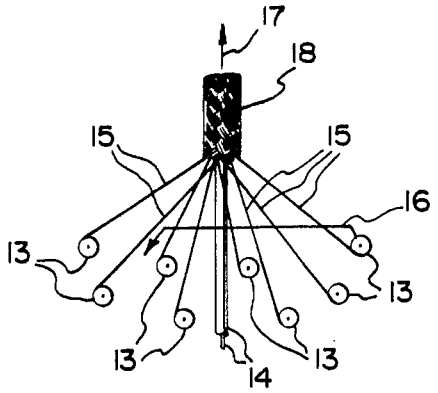
Figure 9:
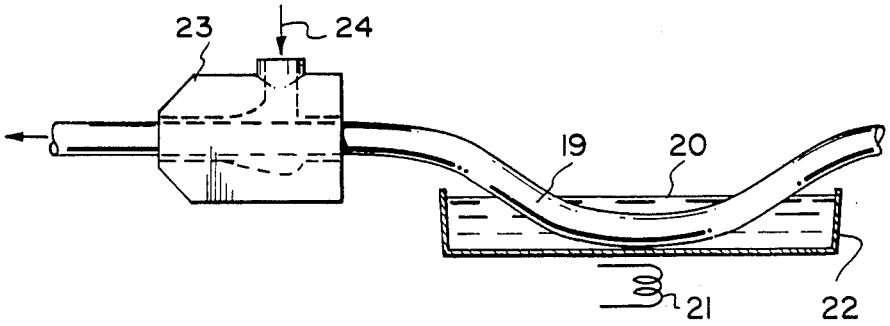

A better understanding of the invention will be obtained by reference to the detailed description of the preferred embodiment below, with reference to the following drawings, in which:

FIGS. 1 and 3 show segments of two types of solid shield cable,

FIGS. 2 and 4 show the cable segments of FIGS. 1 and 3 respectively after being bent, FIG. 5 shows a braided shield coaxial cable, FIGS. 6 and 7 show different segments of a coaxial cable resulting from use of the present invention at different positions thereof along its length, FIG. 8 shows a schematic diagram of a braiding machine, and FIG. 9 shows a flooding bath used in the final steps of the inventive method.

FIGS. 1 and 3 show two prior art forms of leaky coaxial cables. The cables consist of an axial wire 1 covered by an insulating dielectric 2. A shield 3 covers the dielectric and a protective jacket 4 covers the shield.

In FIG. 1 the shield is wound so as to create a spiral slot 5 continuously over the length of the cable.

While this cable allows radio frequency leakage through the slot along its length, it has several significant deficiencies, one of which is illustrated in FIG. 2. When the cable is bent, the slots at the inner radius narrow or squeeze close and the slots at the outer radius widen. The amount of radio frequency radiation from the cable thus becomes unsymmetrical and unpredictible, particularly since the slots are hidden under the protective jacket. If the radius of the bend is short, parts of the shield can ride up over adjacent parts, thus distorting them.

The jacket 4 is tight on the shield, and when the cable is straightened, the ends of the slots have been found to catch into the inside surface of the jacket, retaining the distortion. Thus even after bending and restraightening, the radiation leakage at predefined locations around cable remains unsymmetrical and unpredictible.

Since the shield is wound as a tape around the cable, attempts to grade the cable by changing the lay angle of the shield would result in the tape not lying flat against the cable. During the manufacturing process, bending of the cable would result in non-uniform gap sizes.

FIG. 3 is a coaxial cable in which the slot is produced by extending a solid shield tape coaxially around the dielectric, leaving an axial slot 6 the length of the cable.

After extruding an insulative and protective jacket 4 around the cable, bending the cable can cause tearing of the jacket, the tear being shown at 7 in FIG. 4.

If the cable is bent in the opposite direction, the axial slot 6 either opens wide or the shield is torn. The presence of the jacket inhibits the shield from regaining its former position when the cable is straightened, resulting in an unreliable and unsymmetrical radiation pattern.

Worse, if the cable is flexed repeatedly in several directions, the entire shield could break around the cable, creating an open circuit.

As noted earlier, coaxial cables which have been found to bend satisfactorily and retain shield integrity utilize braided shields, as shown in FIG. 5. This type of cable contains an axial wire 1, a insulating dielectric 2 surrounding the wire, and a woven conductive shield 8 covered by a protective jacket 4. Such coaxial cable shields are formed of groups of wires, referred to as bobbins, the number of wires or ends within the bobbins are typically between 2 and 10 in number. The bobbins are usually woven over 2 and under 2, as shown in FIG. 5.

It is usually very difficult to provide a filling factor, which provides an indication of the amount of radiation or loss from the cable, to exceed 0.95 (unity would be ideal). The looseness of the braid, the number of picks, (i.e. bobbin crossing) per inch and other factors decrease the filling factor. Clearly the number of crossings increases as the number of wires in each bobbin decreases, and thus the filling factor decreases and the radiation from the cable increases. In the aforenoted U.S. Pat. No. 4,091,367, radiation from the woven shield cable is provided by grading it loosely, and providing slots in the shield at intervals at about 1 foot. While a lossy cable is provided, there is no provision for grading, for progressively increasing the loss from the cable in a predictable manner without increasing the number of slots per foot, performed presumably by opening holes in the shield by hand.

The present invention is a method for producing a graded coaxial cable which can be mass produced in a relatively simple manner. A graded coaxial cable is produced in which the filling factor is variable along the cable, the points of radiation are closely spaced and thus substantially symmetry and predictability of the radio frequency field surrounding the cable is facilitated.

In the present invention as the shield is woven around the dielectric which surrounds the axial wire, ends of the braid are dropped according to a predefined schedule. By dropping the ends, it is meant that the wire from a particular bobbin is tied up and not fed to the braiding machine. FIG. 6 shows the result; ends have been dropped and holes in the shield are produced where the bobbins surrounding the cable along lines indicated by arrows 9 and 10 would have passed. The holes, shown as diamond shaped gaps 11 are produced along the cable from which the electromagnetic field can escape.

As the shield is progressively wound along the cable, more and more ends are dropped according to the schedule, enlarging the diamond shaped gaps 11 as shown in FIG. 7. The result is that a radio frequency electromagnetic field which leaks from such a coaxial cable down which a radio frequency signal is passed, is graded.

Coaxial cable shield braiding machines are well known. For example one such machine which may be used in the method of this invention is 24 Carrier Wardwell Braiding Machine. FIG. 8 is a schematic diagram showing the basic elements of a shield braiding machine.

A plurality of wire bobbins 13 surround the dielectric 14 on two levels. Preferably the dielectric is cellular polyethylene, although any suitable dielectric can be used. The wires 15 from the bobbins, placed against the dielectric, are both rotated around the dielectric and simultaneously woven. For example for an over 2, under 2 weave, every third upper level bobbin passes over two upper level bobbins, then is dropped to the lower level as shown by the direction arrow 16, while bobbins from the lower level rise to the upper level. At the same time the cable 14 is pulled upwardly in the direction of arrow 17. The result is a shield 18 which is progressively woven around the dielectric.

The shielded wire is then wound on storage spools or is fed directly to the next stage of processing.

In order to grade the cable, wire ends from the predetermined bobbins 13 are cut. The loose end of the wire on the bobbin is tied back to the bobbin. Weaving of the shield progresses leaving gaps where the cut ends would have been. As the braiding continues, a variation in the number of bobbins is used according to a predefined schedule, thus changing the size of the gaps in the shield, resulting in a cable as shown in FIGS. 6 and 7 which has progressive radiation leakage grading.

In a typical cable design, a first length of manufactured cable would be a braided lead-in, preferably having minimum possible loss. For the lead-in length, the dielectric is covered with a bonded shielding tape. A length following the lead-in would be produced using a specified number of carriers on top and bottom of the braiding machine. A further typical length may be produced by changing the number of carriers on top and/or bottom. This would continue as desired to provide the progressive change in gap size. Each successive length has increasing or decreasing radio frequency field leakage from the previous due to the progressive increase or decrease of gap size in the shield, as desired.

In some cable designs it may be desirable to utilize insulative fillers in place of the dropped ends. In that case the filler is laid into the braid in place of the dropped ends. A filler bobbin can be placed on the same axle as the wire bobbin in order to facilitate the substitution.

In addition to the above, the gap size can be changed by varying the number of ends per bobbin, and/or varying the lay angle of the ends as the shield is braided.

One wire that can be used in the shield is #33 AWG copper. For use as a filler, the same gauge non-conductive material should be used, but it is preferred that it should be "oriented", that is, the stretch taken out of it. The same tensile and elongation characteristics as the shield wire should also be used, such as is obtained with polypropylene or nylon, for example.

FIG. 9 illustrates the next stage of processing. The shielded cable 19 is passed into a bath container 22 containing a flooding agent 20. The flooding agent should be of the gell type which melts when heated (an electric heater coil 21 being shown under the container 22 supplying the heat for the flooding agent). It is preferred that the flooding agent should be in the form of a liquid during application, in order that it should penetrate the interstices of the shield and adhere to its surface. However after cooling the flooding agent reverts to a waxy semi-resilient form. As a result a continuous coating is produced which repels water. The resulting cable has been found to be very successfuly used in radio frequency field type intruder detectors as described earlier, in which the cables are buried underground.

The use of a flooding agent as described has the further advantage of not leaking through pinholes as sometimes occurs in cables which utilize gummy or syrupy types of flooding agents. A typical flooding agent that is preferred is a blend of petroleum waxes and polypropylene.

The braid coated with the liquid flooding agent is then drawn through a die 23 into which the heated jacket material enters, i.e. through orifice 24. The jacket material preferably is polyethylene, which has physical characteristics which can withstand abrasion and soil acidity, and is also non-contaminating. After being drawn through the die, the cable is cooled, e.g. by immersion into a water bath. The jacket solidifies and the flooding agent turns to a waxy, semi-solid and somewhat resilient material.

Using the process described above, a graded coaxial cable is produced which can be flexed, wound on reels and straightened while maintaining closely spaced and relatively constant gap size necessary to produce a symmetrical and predictable field around the cable when carrying a radio frequency signal. The waxy flooding agent substantially rejects contaminants which may enter the jacket due to damage to the cable.

It was noted earlier that the described method facilitates the manufacture of a graded leaky coaxial cable. Indeed, the method can be used to fabricate a leaky coaxial cable which will have a substantially constant field surrounding it over its length when it is in a homogeneous ambient medium and has a radio frequency signal applied between its center conductor and the shield at its end at which the shield has the most ends. The shield facilitates controlled penetration of a radio frequency signal in either direction.

In general, the leaky coaxial cable according to this invention is comprised of a center conductor, a dielectric surrounding the center conductor, and a woven conductive shield surrounding the dielectric, the shield having progressively fewer ends along its length whereby progressively larger non-conductive gaps are formed. This structure facilitates controlled penetration of radio frequency electric and electromagnetic fields through the shield.

This invention distinguishes clearly from the woven shield cable described in the aforenoted Harman patent in which the controlled leakage is obtained by providing holes in the braid, the holes, which appear to be cut, being of constant size. In the present invention the cable has fewer ends along its length; the number of gaps per unit length is constant but they increase in size as ends are dropped. However it is contemplated that in the present invention increasing numbers of gaps per unit length could be obtained by dropping ends which causes the gaps to be formed automatically, rather than by cutting holes in a shield which has the maximum number of ends run the entire length, as in the aforemoted Harman patent.

Clearly according to the preferred embodiment the gap sizes are progressively increased according to a predefined schedule in order to obtain gap sizes which increase the radio frequency field penetration of the cable. The progressive result of dropping the wire ends of the shield is shown in FIGS. 6 and 7, the gaps in the shield being referenced 11.

It is intended that the dropping or elimination of ends progressively along the cable means either complete removal of conductive wires in the shield (usually copper) or the substitution for the conductive wires of an insulative filler such as polypropylene or nylon, preferably having the same tensile and elongation characteristics as the ends for which it is substituted, and having the same gauge.

It should be noted that both the center conductor of the cable and the shield have resistance, which affects the attenuation of the cable. Likewise, the signal is further attenuated by losses in the dielectric material used between the inner and outer conductors. Consequently it is not sufficient to merely present gaps of constant size along the cable to obtain a constant field, but it is necessary to increase the gap size along the cable starting from the end to which the radio frequency energy is applied, or from which it is received. While the amount of signal released through the gaps in the shield is a complex function of the gap dimensions, it does increase monotonically, but not linearly with increasing area. In addition, as the gap size increases there are fewer wires in the shield, and the shield resistance increases, requiring compensating gap size increases. Consequently the rate of gap size change is not constant along the cable. It has been found that close to the transmitting or receiving end of the cable, the change in gap size should occur at shorter intervals, the intermediate portion of the cable should have the shield gap size changed at longer intervals, and toward the far end of the cable the change in shield gap size should be at shorter intervals than at the intermediate portions.

For example, in the case in which the shield is woven in groups of ends over two and under two, the number of wires in alternate upper groups should be decreased by one at successive extending predetermined lengths, whereby the final two lengths are each approximately the same length, the immediately previous length thereto is approximately 1½ times the length of the last length, and the first length is slightly longer than the last length in the event there is a further length between the first and the aforenoted previous length. The first length should be about two-thirds the length of the last length in the event there is no further length between the first length and the aforenoted previous length. In case the further length is present, it should be slightly longer than the aforenoted previous length.

Therefore, in the event the cable is relatively long (e.g. about 500 feet) intermediate lengths are present which are long and are approximately the same length as each other. The final two lengths are approximately the same length as each other but are each about two-thirds the length of the intermediate length. The first length has a length between the length of the last length and the intermediate length. In the event the cable is shorter (e.g. about 325 feet), in which one of the intermediate lengths is not present, the first length should be shorter than the last length.

In summary, the lengths are short at the beginning of the cable, long in intermediate portions, and short towards the end. The shorter the cable, the shorter is the first length.

While the exact lengths at which the ends are dropped will depend on the length of the cable, the guage of the ends, the resistance of the wire, the looseness of the weave, the permittivity of the dielectric material, and the characteristics of the surrounding medium, and thus the exact lengths between places at which the ends are dropped to obtain a constant field would have to be determined by trial and error, the following table will be a guide to experimentally determined coaxial cable shields in a leaky RG-8-U type cable which resulted in constant fields in a homogeneous surrounding earth medium operating at about 40 mHz. (the cables were buried approximately one foot deep).

| Number of Upper Carriers | Number of Lower Carriers | Successive Lengths |
|---|---|---|
| | First Cable | |
| 8 | 7 | 52 ft. |
| 7 | 7 | 122 ft. |
| 7 | 6 | 78 ft. |
| 6 | 6 | 76 ft. |
| | Total Length | 328 ft. |
| | Second Cable | |
| 8 | 8 | 85 ft. |
| 8 | 7 | 131 ft. |
| 7 | 7 | 122 ft. |
| 7 | 6 | 78 ft. |
| 6 | 6 | 76 ft. |
| | Total Length | 492 ft. |

The cable produced as noted above utilized No. 33 AWG copper. A gell type flooding agent as described earlier was coated over and melted into the shield, solidifying to a waxy semi-resilient form and the cable was covered with a heavy polyethylene protective jacket.

The cable described above has been found to be useful in an intruder detector system in which a radio frequency signal is applied to the leaky buried coaxial cable, which produces a constant field therearound along its length. The field is received in an adjacent similar buried cable, the received energy being detected in a field analyzer. Any intruder into the field modifies the amplitude and/or phase characteristics of the received field, allowing the field analyzer to determine the existance, or the location of the intrusion. Clearly a constant field penetration characteristic is essential in both the transmitting cable and the receiving cable in order to ensure that there are no insensitive regions where an intruder can penetrate the protective area without detection.

It should also be noted that other leakage characteristics can be obtained using this invention. For example, it might be desireable to concentrate high field leakage along a particular length of cable, in order to greatly increase the sensitivity or enlarge the range of the detection system in a particular vicinity. The schedule of dropping ends would be such that a large number of ends would be dropped at the beginning of the highly sensitive area, increasing the gap size substantially, and substantially increasing the leakage.

Other variations of the invention will now become apparent to a person skilled in the art having read this specification and understanding this invention.

We claim:

1. A method of making a leaky coaxial cable comprising:

(a) preparing a conductive axial wire covered by an insulating dielectric, (b) progressively braiding a conductive braid shield around the dielectric, and (c) dropping ends of the braid according to a predefined schedule for successive lengths of the braid shield, to produce progressively larger gaps in the braid shield as the ends are dropped whereby graded leakage of signal carried by the cable is facilitated.

2. A method as defined in claim 1 including the further steps of covering the braid with a flooding agent, covering the flooded braid with an insulating protective jacket, and causing the flooding agent to solidify.

3. A method as defined in claim 1 or 2, including braiding insulative fillers in the braid in place of the dropped ends.

4. A method as defined in claim 2 wherein the protective jacket is polyethylene.

5. A method as defined in claim 1, 2 or 4, including the step of changing the number of ends per carrier for successive lengths of the cable according to a predetermined schedule to vary the area of the gaps.

6. A method as defined in claim 1, 2 or 4 including the steps of changing the number of ends per carrier and of varying the angle of the ends of the shield for successive lengths of the cable according to a predefined schedule to vary the configuration and area of the gaps.

7. A method of making a coaxial cable comprising:

(a) progressively drawing a conductive axial wire covered by a cellular polyethylene insulating dielectric through a shield braiding machine, (b) braiding a conductive wire shield around the dielectric using wire ends supplied from a plurality of bobbins carried on the machine, (c) cutting wire ends from predetermined ones of the bobbins, (d) braiding the shield using the same lay angle and continuing with the same braiding schedule, but without the cut ends, while continuing to draw the dielectric and shield covered wire through the machine, whereby gaps in the shield braid along the cable are produced.

8. A method as defined in claim 7, including:

(a) heating a meltable flooding agent to a liquid consistency in a bath container, (b) drawing the shield covered wire through the bath container whereby the flooding agent fills interstices within the cable, (c) drawing a protective jacket over the flooded cable, and (d) cooling the cable, thus solidifying the jacket and the flooding agent to a gell.

9. A method of making a leaky coaxial cable comprising:

(a) preparing a conductive axial wire covered by an insulating dielectric, (b) progressively braiding a conductive braid shield around the dielectric, (c) dropping ends of the braid according to a predefined schedule for successive lengths of the braid shield, and (d) braiding insulative fillers in the braid in place of the dropped braid ends, whereby progressively larger gaps in the braid shield filled by insulated fillers are produced as the ends are dropped and graded leakage of signal carried by the cable is facilitated.

10. A method as defined in claim 9 including the further steps of covering the braid with a flooding agent, covering the flooded braid with an insulating protective jacket, and causing the flooding agent to solidify.

11. A method as defined in claim 10, including braiding insulative fillers in the braid in place of the dropped ends.

12. A method as defined in claim 10 wherein the protective jacket is polyethylene.

13. A method as defined in claim 10, including the step fo changing the number of ends per carrier for successive lengths of the cable according to a predertermined schedule to vary the area of the gaps.

14. A method as defined in claim 10, including the steps of changing the number of ends per carrier and of varying the angle of the ends of the shield for successive lengths of the cable according to a predefined schedule to vary the configuration and area of the gaps.

* * * * *

UNITED STATES PATENT AND TRADEMARK OFFICE

CERTIFICATE OF CORRECTION

PATENT NO. : 4,599,121

DATED : July 8, 1986

INVENTOR(S) : Hugh A. Edwards, et al.

It is certified that error appears in the above-identified patent and that said Letters Patent is hereby corrected as shown below:

Col. 8, line 61, (claim 13, line 2), change "fo" to --of--.

Col. 8, lines 62-63 (claim 13, lines 3-4), change "predertermined" to --predetermined--.

Signed and Sealed this

Fourth Day of November, 1986

[SEAL]

*Attest:*

DONALD J. QUIGG

*Attesting Officer*

*Commissioner of Patents and Trademarks*